US009881750B2

(12) United States Patent
Chen

(10) Patent No.: US 9,881,750 B2
(45) Date of Patent: Jan. 30, 2018

(54) MULTICOLOR ILLUMINATED KEYBOARD

(71) Applicant: Primax Electronics Ltd., Neihu, Taipei (TW)

(72) Inventor: Chung-Yuan Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 128 days.

(21) Appl. No.: 14/992,844

(22) Filed: Jan. 11, 2016

(65) Prior Publication Data

US 2017/0117105 A1 Apr. 27, 2017

(30) Foreign Application Priority Data

Oct. 23, 2015 (TW) ..... 104134935 A

(51) Int. Cl.

| | |
|---|---|
| ***H01H 9/00*** | (2006.01) |
| ***H01H 13/02*** | (2006.01) |
| ***H01H 13/705*** | (2006.01) |
| ***H01H 13/83*** | (2006.01) |

(52) U.S. Cl.

CPC ..... *H01H 13/023* (2013.01); *H01H 13/705* (2013.01); *H01H 13/83* (2013.01); *H01H 2219/054* (2013.01)

(58) Field of Classification Search

CPC ..... H01H 13/023; H01H 9/182; F21V 9/08; F21V 9/10

USPC ..... 200/311; 362/23.03, 293; 340/815.65, 340/815.69; 345/170

See application file for complete search history.

(56) References Cited

U.S. PATENT DOCUMENTS

| | | | | |
|---|---|---|---|---|
| 9,691,569 | B2 * | 6/2017 | Chen | H01H 13/023 |
| 2012/0229389 | A1 * | 9/2012 | Nishino | G06F 3/0202 345/170 |

* cited by examiner

*Primary Examiner* — Vanessa Girardi

(74) *Attorney, Agent, or Firm* — Kirton McConkie; Evan R. Witt

(57) ABSTRACT

A multicolor illumination keyboard includes a light-emitting element, a color filter and plural keys. The plural keys are located above the light-emitting element. The color filter is arranged between the plural keys and the light-emitting element. After a source light emitted by the light-emitting element passes through the color filter, plural color lights are generated. The plural color lights are outputted from the plural keys. Consequently, the plural keys are illuminated in a multicolor manner.

11 Claims, 8 Drawing Sheets

MULTICOLOR ILLUMINATED KEYBOARD

FIELD OF THE INVENTION

The present invention relates to a computer keyboard, and more particularly to a multicolor illumination keyboard.

BACKGROUND OF THE INVENTION

A computer keyboard is one of the essential devices in the modern lives. By pressing one or more keys of the keyboard, a corresponding character or a corresponding command is issued to a computer. Generally, various symbols are marked on a keycap of the key for facilitating the user to input the character or the command. For example, these symbols include an English alphabet, a phonetic notation, a punctuation mark, and so on. In other words, the symbols marked on different keys are different. For complying with different languages or different input methods, four or five symbols with different properties are possibly marked on one key. Consequently, it is difficult to recognize the symbols.

Nowadays, some kinds of keyboards are equipped with light-emitting elements and light guide plates. The light beams emitted by the light-emitting elements are scattered to the regions around the keys or the light beams are transmitted through the keycaps of the keys. Consequently, the users can clearly view the symbols on the keys when the keyboards are used or operated in a dim or dark environment. However, since the keyboard has so many keys and the lighting area is very large, the white light or the single color light is used in the illuminated keyboard. Under this circumstance, the symbols with different properties and on the key are difficultly highlighted. That is, the complicated symbols usually confuse the user. Therefore, the conventional technology needs to be further improved.

SUMMARY OF THE INVENTION

The present invention provides a multicolor illumination keyboard. The multicolor illumination keyboard is capable of changing the colors of the source light. In particular, plural symbols with different properties and on the single key can generate different color lights. By using the multicolor illumination keyboard of the present invention, the user can recognize the symbols more easily. Consequently, the drawbacks of the conventional technology can be overcome In accordance with an aspect of the present invention, there is provided a multicolor illumination keyboard. The multicolor illumination keyboard includes a light-emitting element, a color filter, and plural keys. The light-emitting element emits a source light to the multicolor illumination keyboard. The color filter is located above the light-emitting element, and allows the source light to pass through. The color filter includes plural filtering regions. In addition, plural color lights are generated after the source light passes through the corresponding filtering regions. The plural keys are disposed over the color filter. Each key includes a keycap. The keycap includes plural light-transmissible regions. After the plural color lights pass through the corresponding light-transmissible regions, the plural color lights are outputted from the key.

In an embodiment, the multicolor illumination keyboard further includes plural elastic elements. Each of the plural elastic elements is aligned with the corresponding keycap. Moreover, the key is returned to an original position in response to elasticity provided by the elastic element. The plural elastic elements are disposed on the color filter. Moreover, the plural elastic elements and the color filter are collaboratively formed as a flexible color filter layer.

In an embodiment, the plural elastic elements and the color filter are integrally formed as a one-piece structure.

In an embodiment, the color filter further includes an upper circuit pattern, and the upper circuit pattern is disposed on a surface of the color filter. The upper circuit pattern and the color filter are collaboratively formed as an upper filtering circuit layer.

In an embodiment, the multicolor illumination keyboard further includes a lower circuit layer and a partition layer. The partition layer is arranged between the upper filtering circuit layer and the lower circuit layer. Moreover, plural switch signals are provided by the upper filtering circuit layer and the lower circuit layer collaboratively.

In an embodiment, the color filter further includes a lower circuit pattern, and the lower circuit pattern is disposed on a surface of the color filter. The lower circuit pattern and the color filter are collaboratively formed as a lower filtering circuit layer.

In an embodiment, the multicolor illumination keyboard further includes an upper circuit layer and a partition layer. The partition layer is arranged between the lower filtering circuit layer and the upper circuit layer. Moreover, plural switch signals are provided by the lower filtering circuit layer and the upper circuit layer collaboratively.

In an embodiment, the multicolor illumination keyboard further includes an upper wiring layer and a lower wiring layer. The color filter is arranged between the upper wiring layer and the lower wiring layer. Moreover, plural switch signals are provided by the upper wiring layer and the lower wiring layer collaboratively.

In an embodiment, each filtering region has a single color. After the source light passes through the filtering region, a single color light of the plural color lights is generated.

In an embodiment, each light-transmissible region is aligned with one corresponding filtering region, so that the single color light passes through the light-transmissible region.

In an embodiment, the light-transmissible regions are separated from each other.

In an embodiment, the multicolor illumination keyboard further includes a membrane switch member, plural elastic elements and plural supporting elements. The membrane switch member is disposed under the plural keys. The plural elastic elements and the plural supporting elements are aligned with the corresponding keys. Each of the plural elastic elements is disposed under the corresponding keycap. Each of the plural supporting elements is arranged around the corresponding elastic element and connected with the corresponding keycap. When the key is pressed down, the membrane switch member is triggered by the corresponding elastic element. While the key is returned to an original position, the key is supported by the supporting element.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments and accompanying drawings.

Figure 1:
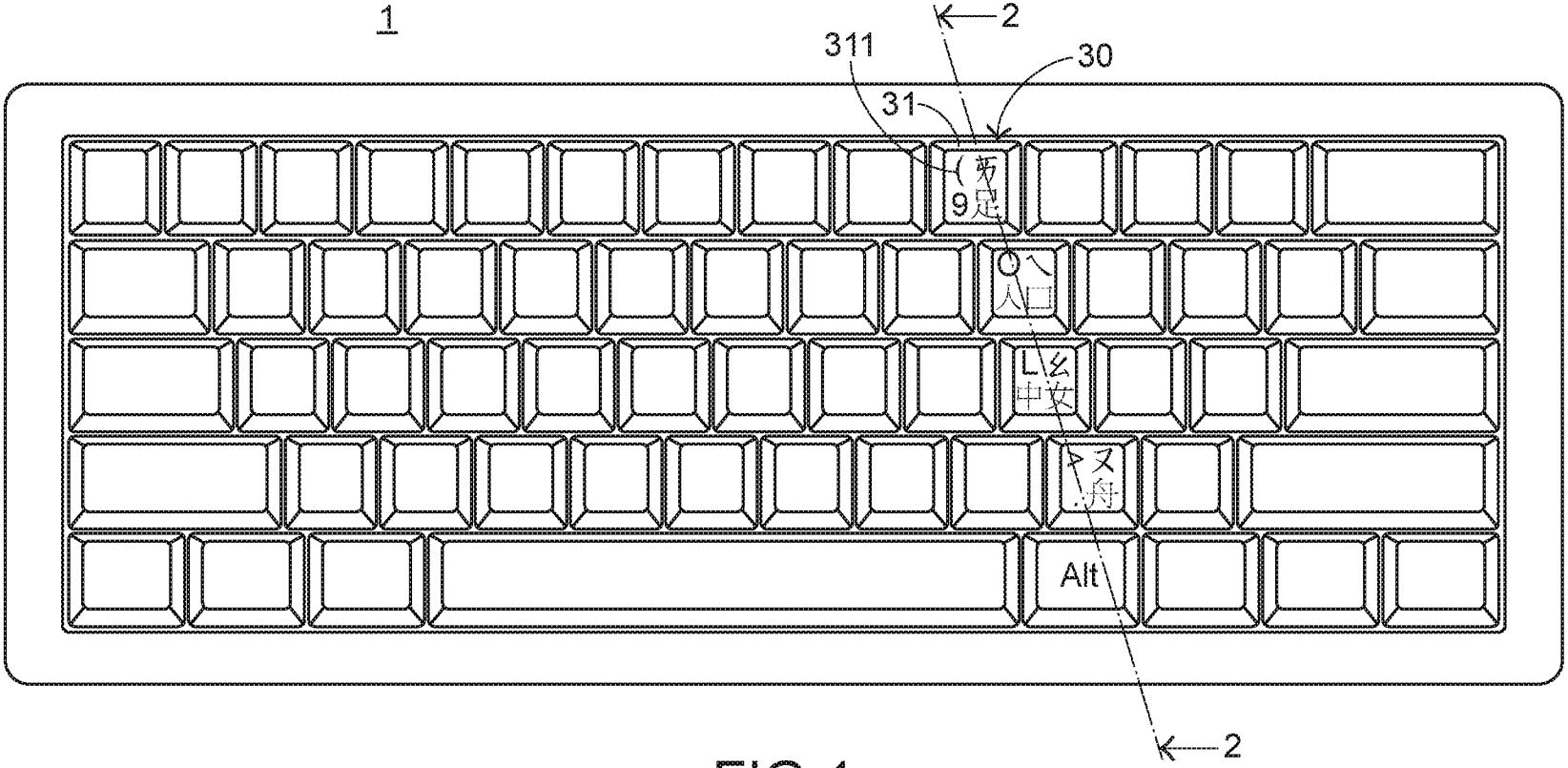
FIG. 1 is a schematic top view illustrating a multicolor illumination keyboard according to an embodiment of the present invention.
Figure 2:
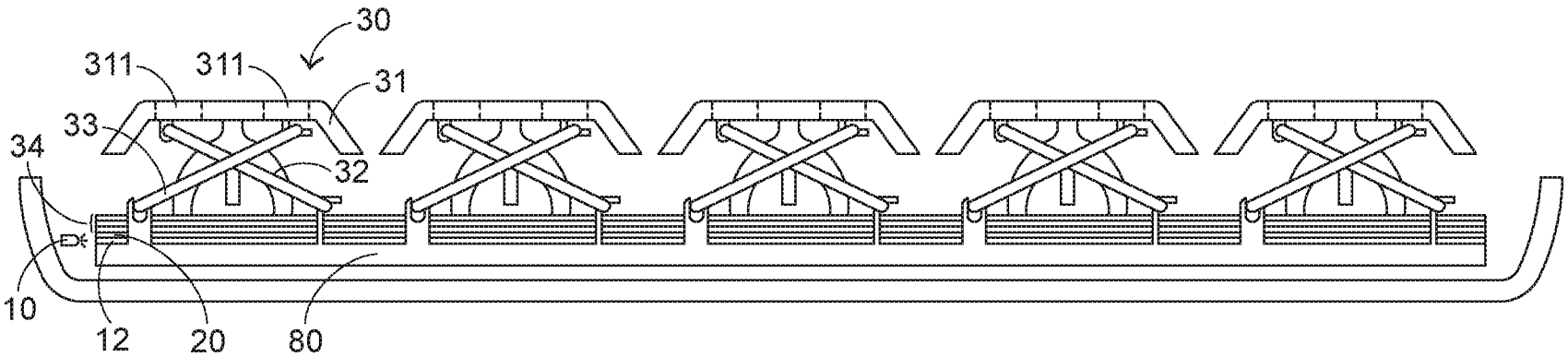
FIG. 2 is a schematic cross-sectional view illustrating the multicolor illumination keyboard of FIG. 1 and taken along the line 2-2.

FIG. 1 is a schematic top view illustrating a multicolor illumination keyboard according to a first embodiment of the present invention. FIG. 2 is a schematic cross-sectional view illustrating the multicolor illumination keyboard of FIG. 1 and taken along the line 2-2. The multicolor illumination keyboard 1 comprises a light-emitting element 10, a color filter 20 and plural keys 30. The color filter 20 is located above the light-emitting element 10. The color filter 20 comprises plural filtering regions 21. Each key 30 comprises a keycap 31 and plural light-transmissible regions 311. The plural light-transmissible regions 311 are located at a top surface of the keycap 31 and aligned with the corresponding light-transmissible regions 311. Consequently, after a source light 11 from the light-emitting element 10 is scattered upwardly and transmitted through the filtering regions 21 of the color filter 20, plural color lights 211 (see FIG. 4) are generated. After the plural color lights 211 are propagated upwardly and transmitted through the corresponding light-transmissible regions 311, the plural color lights 211 are outputted from the key 30.

Figure 3:
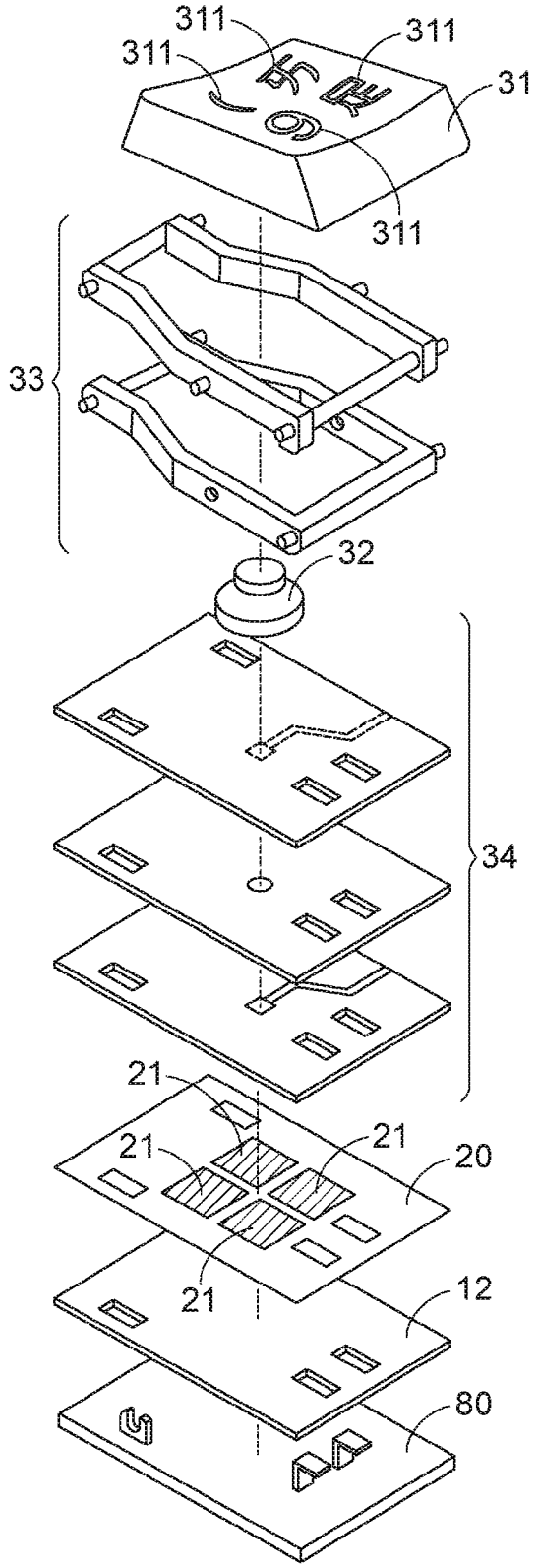
FIG. 3 is a schematic perspective view illustrating a key of the multicolor illumination keyboard according to the embodiment of the present invention.
Figure 4:
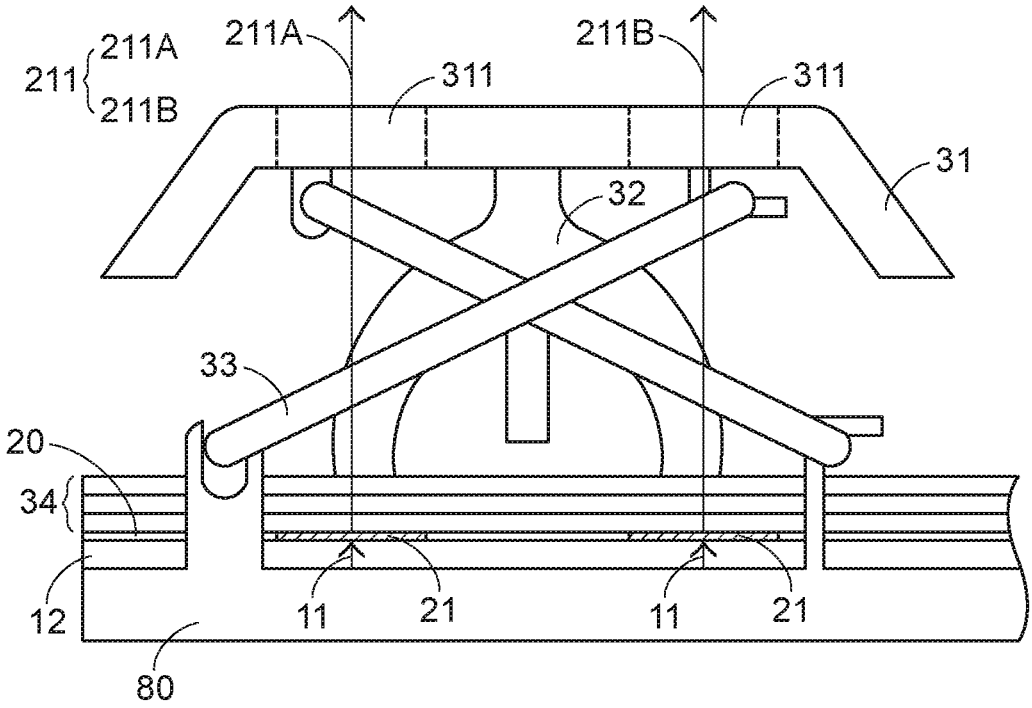
FIG. 4 is a schematic cross-sectional view illustrating the key of FIG. 3.

Hereinafter, the present invention will be illustrated in more details with reference to FIGS. 3 and 4. FIG. 3 is a schematic perspective view illustrating a key of the multicolor illumination keyboard according to the embodiment of the present invention. FIG. 4 is a schematic cross-sectional view illustrating the key of FIG. 3. The multicolor illumination keyboard 1 comprises a base plate 80, a light guide plate 12, a membrane switch member 34, plural elastic elements 32 and plural supporting elements 33.

For succinctness and brevity, the structure of one key 30 will be described in more details as follows. As shown in FIG. 3, the light guide plate 12 is disposed on the base plate 80. The light-emitting element 10 is arranged beside the light guide plate 12. After the source light 11 emitted by the light-emitting element 10 is introduced into the light guide plate 12, the source light 11 is guided to the locations under the keys 30. Then, the source light 11 is propagated upwardly and transmitted through the key 30. The color filter 20 is disposed over the light guide plate 12. The color filter 20 comprises the plural filtering regions 21. These filtering regions 21 have different colors, and the source light 10 is transmissible through the filtering regions 21. The membrane switch member 34 is light-transmissible. In addition, the membrane switch member 34 is disposed over the color filter 20. The elastic element 32 is disposed over the membrane switch member 34 and disposed under the corresponding keycap 31. The supporting element 33 is connected with the base plate 80 and the corresponding keycap 31, and arranged around the corresponding elastic element 32. When the keycap 31 of the key 30 is pressed down, the corresponding elastic element 32 is moved downwardly to trigger the membrane switch member 34. Consequently, an input signal is generated. On the other hand, while the elastic element 32 is restored to its original shape, the keycap 31 is moved upwardly and the keycap 31 is supported by the supporting element 33 and returned to its original shape.

The mechanism of generating different color lights will be illustrated as follows. Please refer to FIG. 4. The structure of one key will be described. The light-emitting element 10 emits the source light 11. For example, the source light 11 has a single color. Preferably, the source light is a white light. After the source light 11 is introduced into the light guide plate 12 and guided to the locations under the key 30, the source light 11 becomes a directional source light and is transmitted through the key 30. While the source light 11 passes through the plural filtering regions 21 of the color filter 20, the plural color lights 211 are generated. In this embodiment, each filtering region 21 has a corresponding color. The colors of the plural filtering regions 21 are identical or different. When the while light 11 passes through a specified filtering region 21, the white light 11 is filtered by the specified filtering region 21, and thus a color light having the color corresponding to the specified filtering region 21 is generated. For example, one filtering region 21 having a red color and another filtering region 21 having a green color are shown in FIG. 4. When the white light 11 passes through the filtering region 21 having the red color, a red beam 211A is generated. When the white light 11 passes through the filtering region 21 having the green color, a green beam 211B is generated. In other words, plural color lights 211 are generated accordingly. Moreover, the key 30 comprises the plural light-transmissible regions 311. These light-transmissible regions 311 are separated from each other. Moreover, each of the light-transmissible regions 311 is aligned with the corresponding filtering region 21 for allowing a single color light 211 to pass through. Preferably, the light-transmissible regions 311 are different symbols marked on the keycap 31. Consequently, after the plural color lights 211 are propagated upwardly and transmitted through the corresponding light-transmissible regions 311, the color lights with different colors are outputted from the light-transmissible regions 311. Since different color lights are outputted from different symbols of the key, these symbols can be easily recognized.

Figure 5:
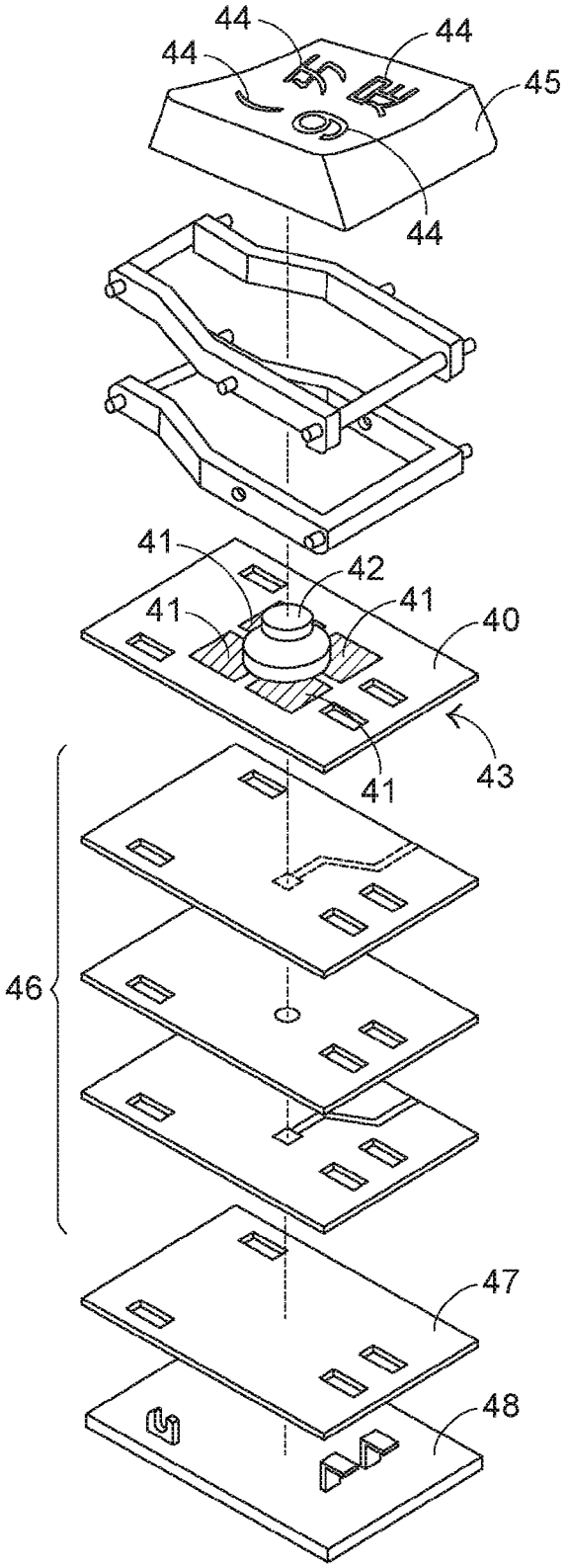
FIG. 5 is a schematic exploded view illustrating a multicolor illumination keyboard according to a second embodiment of the present invention.

FIG. 5 is a schematic exploded view illustrating a multicolor illumination keyboard according to a second embodiment of the present invention. In this embodiment, the multicolor illumination keyboard comprises plural elastic elements 42. Each elastic element 42 is aligned with a corresponding key. The plural keys are disposed on the base plate 48. The structure of one key will be described as follows. The elastic element 42 is disposed under the corresponding keycap 45. The elastic element 42 is disposed on the color filter 40. Moreover, the elastic element 42 and the color filter 40 are collaboratively formed as a flexible color filter layer 43. Preferably, the elastic element 42 and the color filter 40 are integrally formed as a one-piece structure and disposed under the corresponding keycap 45. Moreover, the plural filtering regions 41 are arranged around a bottom surface of the elastic element 42, and aligned with the corresponding light-transmissible regions 44 of the keycap 45. The light guide plate 47 is disposed over the base plate 48. Moreover, the light guide plate 47 is used for guiding the source light to the location under the key. After the source beam is propagated upwardly and transmitted through the filtering regions 41 of the flexible color filter layer 43, plural color lights are generated. After the plural color lights are propagated upwardly and transmitted through the corresponding light-transmissible regions 44, the color lights with different colors are outputted from the single key. When the keycap 45 is pressed down, the corresponding elastic element 42 is moved downwardly to trigger the membrane switch member 46, and thus an input signal is generated. Moreover, while the key is returned to an original position, the key is supported by the supporting element 42.

Figure 6:
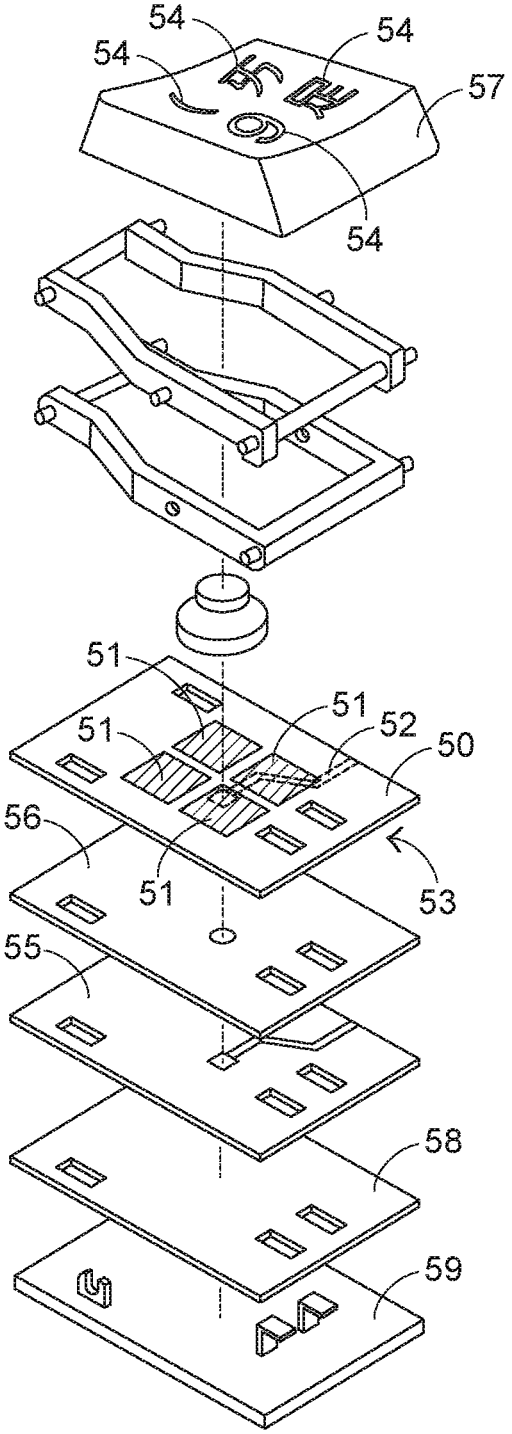
FIG. 6 is a schematic exploded view illustrating a multicolor illumination keyboard according to a third embodiment of the present invention.

FIG. 6 is a schematic exploded view illustrating a multicolor illumination keyboard according to a third embodiment of the present invention. In this embodiment, the color filter 50 of the multicolor illumination keyboard further comprises an upper circuit pattern 52. The upper circuit pattern 52 is disposed on a surface of the color filter 50. Preferably, the upper circuit pattern 52 is disposed on a top surface or a bottom surface of the color filter 50. Consequently, the upper circuit pattern 52 and the color filter 50 are collaboratively formed as an upper filtering circuit layer 53. The upper filtering circuit layer 53 is disposed under the keycap 57. The plural filtering regions 51 are formed in the upper filtering circuit layer 53, and arranged around the upper circuit pattern 52. The plural filtering regions 51 are aligned with the corresponding light-transmissible regions 54 of the keycap 57. The light guide plate 58 is disposed over the base plate 59. After the source light is introduced into the light guide plate 58 and guided to the locations under the keycap 57, the source light passes through the plural filtering regions 51. Consequently, plural color lights are generated. After the plural color beams pass through the corresponding light-transmissible regions 54, the plural color lights are outputted from the key. In this embodiment, the multicolor illumination keyboard further comprises a lower circuit layer 55 and a partition layer 56. The lower circuit layer 55 is disposed under the upper filtering circuit layer 53. The partition layer 56 is arranged between the upper filtering circuit layer 53 and the lower circuit layer 55. When the key is pressed down, the upper filtering circuit layer 53 deforms downwardly to touch the lower circuit layer 55. Consequently, plural switch signals are generated and issued to a computer. When the key is not pressed down, the upper filtering circuit layer 53 and the lower circuit layer 55 are separated from each other by the partition layer 56. Consequently, no switch signals are generated.

Figure 7:
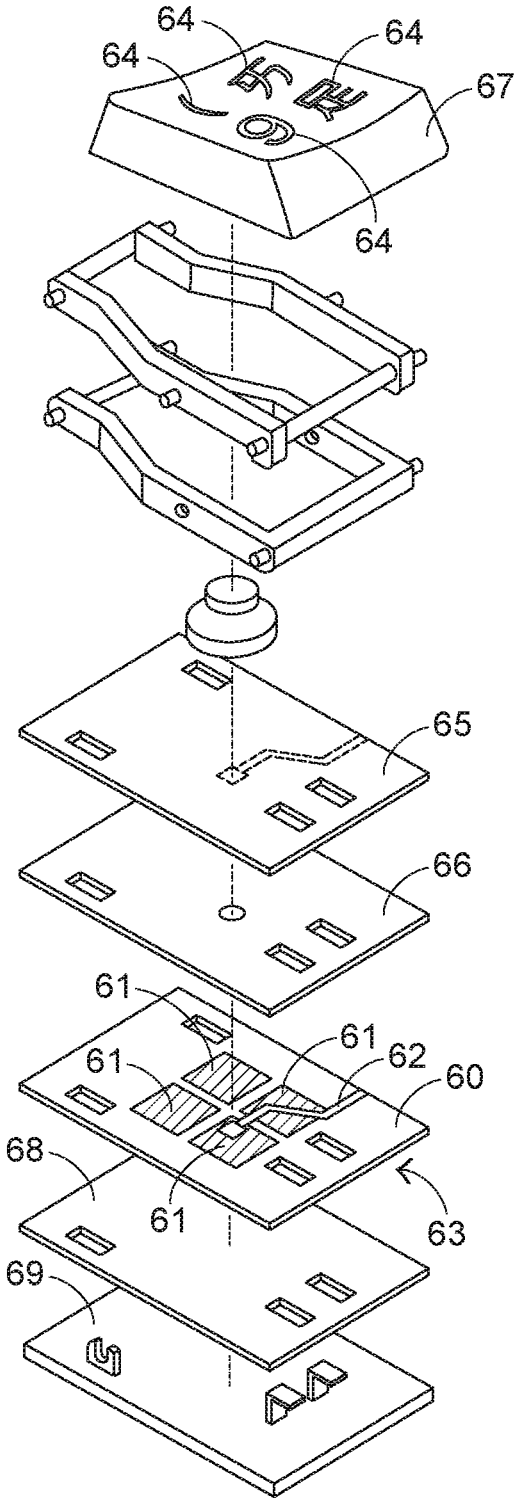
FIG. 7 is a schematic exploded view illustrating a multicolor illumination keyboard according to a fourth embodiment of the present invention.

FIG. 7 is a schematic exploded view illustrating a multicolor illumination keyboard according to a fourth embodiment of the present invention. In this embodiment, the color filter 60 of the multicolor illumination keyboard further comprises a lower circuit pattern 62. The lower circuit pattern 62 is disposed on a surface of the color filter 60. Preferably, the lower circuit pattern 62 is disposed on a top surface or a bottom surface of the color filter 60. Consequently, the lower circuit pattern 62 and the color filter 60 are collaboratively formed as a lower filtering circuit layer 63. The lower filtering circuit layer 63 is disposed under the keycap 67. The plural filtering regions 61 are formed in the lower filtering circuit layer 63, and arranged around the lower circuit pattern 62. The plural filtering regions 61 are aligned with the corresponding light-transmissible regions 64 of the keycap 67. The light guide plate 68 is disposed over the base plate 69. After the source light is introduced into the light guide plate 68 and guided to the locations under the keycap 67, the source light passes through the plural filtering regions 61. Consequently, plural color lights are generated. After the plural color beams pass through the corresponding light-transmissible regions 64, the plural color lights are outputted from the key. In this embodiment, the multicolor illumination keyboard further comprises an upper circuit layer 65 and a partition layer 66. The upper circuit layer 65 is disposed over the lower filtering circuit layer 63. The partition layer 66 is arranged between the upper circuit layer 65 and the lower filtering circuit layer 63. When the key is pressed down, the upper circuit layer 65 deforms downwardly to touch the lower filtering circuit layer 63. Consequently, plural switch signals are generated and issued to a computer. In response to the switch signals, corresponding characters or signals are inputted to the computer. When the key is not pressed down, the upper circuit layer 65 and the lower filtering circuit layer 63 are separated from each other by the partition layer 66. Consequently, no switch signals are generated.

Figure 8:
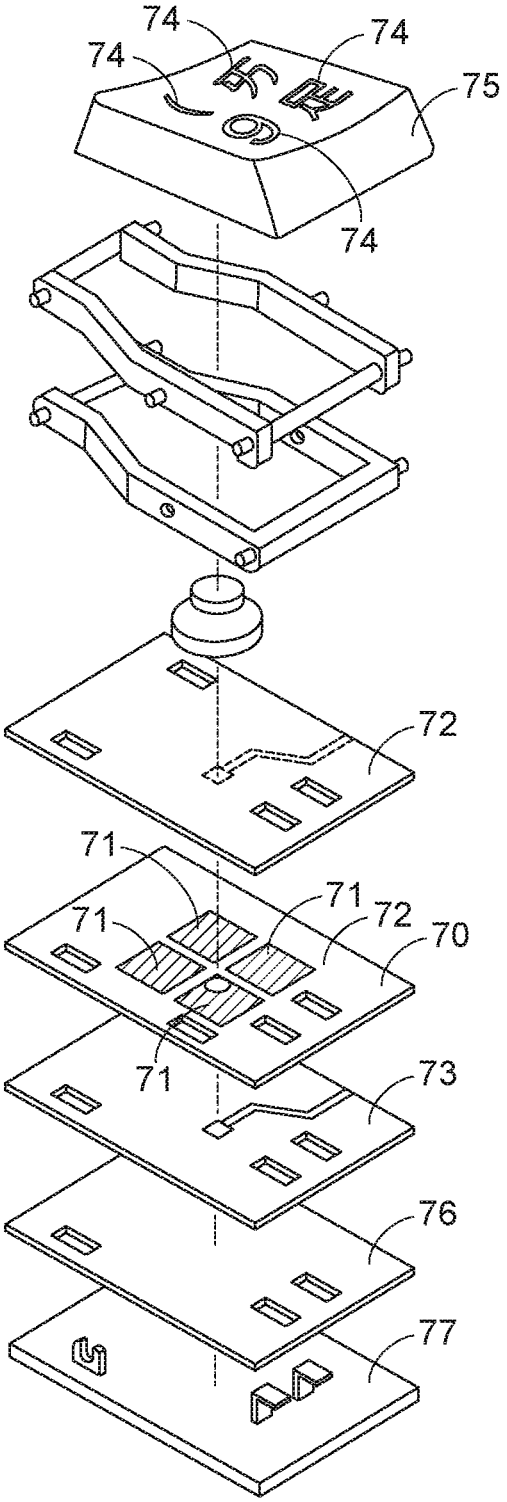
FIG. 8 is a schematic exploded view illustrating a multicolor illumination keyboard according to a fifth embodiment of the present invention.

FIG. 8 is a schematic exploded view illustrating a multicolor illumination keyboard according to a fifth embodiment of the present invention. In this embodiment, the multicolor illumination keyboard further comprises an upper wiring layer 72 and a lower wiring layer 73. The upper wiring layer 72 is disposed under the keycap 75. The lower wiring layer 73 is disposed under the upper wiring layer 72. The color filter 70 is arranged between the upper wiring layer 72 and the lower wiring layer 73. The plural filtering regions 71 are formed in the color filter 70, and aligned with the corresponding light-transmissible regions 74 of the keycap 75. The light guide plate 76 is disposed over the base plate 77. After the source light is introduced into the light guide plate 76 and guided to the locations under the keycap 75, the source light passes through the plural filtering regions 71. Consequently, plural color lights are generated. After the plural color beams pass through the corresponding light-transmissible regions 74, the plural color lights are outputted from the key. When the key is pressed down, the upper wiring layer 72 deforms downwardly to touch the lower wiring layer 73. Consequently, plural switch signals are generated and issued to a computer. In response to the switch signals, corresponding characters or messages are inputted to the computer. When the key is not pressed down, the upper wiring layer 72 and the lower wiring layer 73 are separated from each other by the color filter 70. Consequently, no switch signals are generated.

From the above descriptions, the present invention provides a multicolor illumination keyboard. The multicolor illumination keyboard is capable of changing the colors of the source light. In particular, plural symbols with different properties and on the single key can generate different color lights. By using the multicolor illumination keyboard of the present invention, the user can recognize the symbols more easily. Consequently, the drawbacks of the conventional technology can be overcome.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A multicolor illumination keyboard, comprising:

a light-emitting element emitting a source light to the multicolor illumination keyboard;

a color filter located above the light-emitting element, and allowing the source light to pass through, wherein the color filter comprises plural filtering regions, and plural color lights are generated after the source light passes through the corresponding filtering regions;

plural keys disposed over the color filter, wherein each key comprises a keycap, and the keycap comprises plural light-transmissible regions, wherein after the plural color lights pass through the corresponding light-transmissible regions, the plural color lights are outputted from the key; and plural elastic elements, wherein each of the plural elastic elements is aligned with the corresponding keycap, and the key is returned to an original position in response to elasticity provided by the elastic element, wherein the plural elastic elements are disposed on the color filter, and the plural elastic elements and the color filter are collaboratively formed as a flexible color filter layer.

2. The multicolor illumination keyboard according to claim 1, wherein the plural elastic elements and the color filter are integrally formed as a one-piece structure.

3. The multicolor illumination keyboard according to claim 1, wherein the light-transmissible regions are separated from each other.

4. The multicolor illumination keyboard according to claim 1, further comprising a membrane switch member, plural elastic elements and plural supporting elements, wherein the membrane switch member is disposed under the plural keys, the plural elastic elements and the plural supporting elements are aligned with the corresponding keys, each of the plural elastic elements is disposed under the corresponding keycap, and each of the plural supporting elements is arranged around the corresponding elastic element and connected with the corresponding keycap, wherein when the key is pressed down, the membrane switch member is triggered by the corresponding elastic element, wherein while the key is returned to an original position, the key is supported by the supporting element.

5. The multicolor illumination keyboard according to claim 1, wherein each filtering region has a single color, wherein after the source light passes through the filtering region, a single color light of the plural color lights is generated.

6. The multicolor illumination keyboard according to claim 5, wherein each light-transmissible region is aligned with one corresponding filtering region, so that the single color light passes through the light-transmissible region.

7. A multicolor illumination keyboard comprising:

a light-emitting element emitting a source light to the multicolor illumination keyboard;

a color filter located above the light-emitting element, and allowing the source light to pass through, wherein the color filter comprises plural filtering regions, and plural color lights are generated after the source light passes through the corresponding filtering regions; and plural keys disposed over color filter, wherein each key comprises a keycap, and the keycap comprises plural light-transmissible regions, wherein after the plural color lights pass through the corresponding light-transmissible regions, the plural color light are outputted from the key, wherein the color filter further comprises an upper circuit pattern, and the upper circuit pattern is disposed on a surface of the color filter, wherein the upper circuit pattern and the color filter are collaboratively formed as an upper filtering circuit layer.

8. The multicolor illumination keyboard according to claim 7, further comprising a lower circuit layer and a partition layer, wherein the partition layer is arranged between the upper filtering circuit layer and the lower circuit layer, wherein plural switch signals are provided by the upper filtering circuit layer and the lower circuit layer collaboratively.

9. A multicolor illumination keyboard comprising:

a light-emitting element emitting a source light to the multicolor illumination keyboard;

a color filter located above the light-emitting element, and allowing the source light to pass through, wherein the color filter comprises plural filtering regions, and plural color lights are generated after the source light passes through the corresponding filtering regions, wherein the color filter further comprises a lower circuit pattern, and the lower circuit pattern is disposed on a surface of the color filter, wherein the lower circuit pattern and the color filter are collaboratively formed as a lower filtering circuit layer, and plural keys disposed over the color filter, wherein each key comprises a keycap, and the keycap comprises plural light-transmissible regions, wherein after the plural color lights pass through the corresponding light-transmissible regions, the plural color lights are outputted from the key.

10. The multicolor illumination keyboard according to claim 9, further comprising an upper circuit layer and a partition layer, wherein the partition layer is arranged between the lower filtering circuit layer and the upper circuit layer, wherein plural switch signals are provided by the lower filtering circuit layer and the upper circuit layer collaboratively.

11. A multicolor illumination keyboard comprising:

a light-emitting element emitting a source light to the multicolor illumination keyboard;

a color filter located above the light-emitting element, and allowing the source light to pass through, wherein the color filter comprises plural filtering regions, and plural color lights are generated after the source light passes through the corresponding filtering regions; and plural keys disposed over the color filter, wherein each key comprises a keycap, and the keycap comprises plural light-transmissible regions, wherein after the plural color lights pass through the corresponding light-transmissible regions, the plural color lights are outputted from the key; and an upper wiring layer and a lower wiring layer, wherein the color filter is arranged between the upper wiring layer and the lower wiring layer, wherein plural switch signals are provided by the upper wiring layer and the lower wiring layer collaboratively.

* * * * *